United States Patent [19]

Buschmann et al.

[11] Patent Number: 4,720,653

[45] Date of Patent: Jan. 19, 1988

[54] ELECTRIC LAMP WITH BRIDGE SUPPORT MEMBER PROVIDING BOTH COMPRESSIVE AND AXIAL SUPPORT

[75] Inventors: Jeffrey P. Buschmann, Lexington; Arnold E. Westlund, Jr., Winchester; David A. Cox, Lexington, all of Ky.

[73] Assignee: GTE Products Corporation, Danvers, Mass.

[21] Appl. No.: 920,634

[22] Filed: Oct. 20, 1986

[51] Int. Cl.[4] ..... H01J 1/88; H01J 19/42

[52] U.S. Cl. ..... 313/275; 313/273; 313/276; 313/279; 313/579; 313/315

[58] Field of Search ..... 313/578, 579, 580, 271, 313/273–279, 315, 344, 272

[56] References Cited

U.S. PATENT DOCUMENTS

| | | | |
|---|---|---|---|
| 3,497,752 | 2/1970 | Peterson | 313/271 |
| 3,543,962 | 12/1970 | Peterson | 313/271 |
| 3,626,236 | 12/1971 | Robinson et al. | 313/271 |
| 3,898,505 | 2/1974 | Danko | 313/271 |
| 3,909,653 | 9/1975 | Bottone et al. | 313/271 |
| 4,023,060 | 5/1977 | Pike et al. | 313/272 |
| 4,366,411 | 12/1982 | Robinson | 313/272 |

*Primary Examiner*—David K. Moore
*Assistant Examiner*—Mark R. Powell
*Attorney, Agent, or Firm*—Lawrence R. Fraley

[57] ABSTRACT

An electric incandescent lamp (e.g., tungsten-halogen) including a light-transmitting envelope having an internal curvilinear wall, a gas mixture within the envelope, at least two support rods extending within the envelope in a spaced-apart manner, at least one bridge member within the envelope and supported substantially between the two support rods, and an electrically conductive filament structure located within the envelope and suspended from the bridge member. At least one support member, secured to the bridge member and projecting therefrom and including a U-shaped end portion for engaging the curvilinear internal wall of the envelope, is utilized to provide both compressive and axial support for the bridge member and suspended filament structure. The support member is preferably a wireform comprised of molybdenum.

12 Claims, 4 Drawing Figures

ELECTRIC LAMP WITH BRIDGE SUPPORT MEMBER PROVIDING BOTH COMPRESSIVE AND AXIAL SUPPORT

TECHNICAL FIELD

This invention relates to electric incandescent lamps in general and has particular reference to high power tungsten-halogen lamps and the filament mount structure thereof.

BACKGROUND

Electric incandescent lamps of the tungsten-halogen variety have proven extremely useful in lighting applications because of their higher efficiency, better maintenance and smaller size in comparison to known incandescent lamps. As a result of this commercial success, tungsten-halogen lamps have been developed with much higher power ratings. These lamps are necessarily larger and present some problems that are not usually encountered with existing incandescent lamps or, for that matter, lower wattage tungsten-halogen lamps. One such problem concerns the adequacy of support for the filament structure within the lamp's light-transmitting envelope. Should proper support not be provided, the filament, typically a coiled tungsten element, can be damaged, rendering the lamp inoperative. Such destruction can result when the lamp is subjected to external forces (i.e., shock) as may occur if the lamp is jarred or dropped (i.e., during shipping). Adequate support is also essential to assure that the filament structure maintains a preestablished, usually centralized, location within the envelope to in turn assure optimum light output for the lamp. This is especially true if the lamp is to be positioned relative to a reflector for directing the lamp's light in a predetermined direction.

In U.S. Pat. No. 3,497,752 (Peterson), assigned to the assignee of this invention, there is shown a filament mount structure wherein the filament, comprised of two coiled elements, is supported only at the ends thereof from a pair of lead-in support rods which in turn are sealed within the lamp's base and project within the envelope's interior. In effect, this seal provides the only support for the support rods and thus the suspended filament.

A subsequent U.S. Pat. No. 3,543,962 (Peterson), also assigned to the same assignee as the instant invention, describes a "folded" filament (one containing several individual coiled elements interconnected at ends thereof by a singular wire) which requires support thereof at the interconnecting (fold) locations. Direct connection of the filament to the support rods, except at the extreme ends thereof, is impossible in a lamp of this type because doing so would electrically short out various parts (segments) thereof.

Tungsten-halogen lamps having such folded coiled filaments, as in U.S. Pat. No. 3,543,962, are sometimes preferable to those having coiled filaments, such as disclosed in U.S. Pat. No. 3,497,752, where it is desired to reduce the effective area of incandescence of the filament as, for example, where the lamp is operated in conjunction with an external reflector and where efficient directional illumination is required, as in motion picture and television lighting. In addition, the corrosive effect of halogen, especially at the high temperatures at which lamps of this type operate, severely limits the materials that can be used within a halogen lamp envelope. Generally, only tungsten and quartz are suitable. In lower wattage lamps, the filament can be welded or hot crimped to the lead-in wire. But, mainly because of the increased wire sizes required, such connections are not usually satisfactory in higher wattage lamps.

The above-mentioned U.S. Pat. No. 3,543,962 discloses a halogen lamp having a bridge which materially stabilizes the central positioning of a folded coiled filament mounted therefrom. The bridge comprises quartz tubing supported by tungsten rods. Filament support wires, inserted through substantially diametral holes in the quartz tubing and supported thereby, insulatively support the filament at the folds thereof. These support wires have sufficient flexibility and adjustability to conveniently permit the takeup of any slack between the quartz tubing and the individual filament folds when the filament is mounted on the bridge. More specifically, one end of each support wire extends through a diametral hole in the quartz tubing and is bent therearound. The opposite end of the support wire extends through and engages a fold of the filament. Between its ends, the support wire has a loop, the loop having sufficient flexibility to permit the legs thereof to be squeezed together. Thus when the filament is mounted on the bridge, any slack in the filament can be taken up by squeezing the loops of the support wires. In some cases, it may be desirable to continue the end of the support wire that engages the filament fold back through the diametral hole in the quartz tubing. Thus, both ends of the support wire extend through the diametral hole and there is effectively a double wire supporting each filament fold. Such a construction can improve the resistance of the filament to sagging, especially when the lamp is operated in a horizontal position.

Preferably, the quartz tubing of each bridge in U.S. Pat. No. 3,543,962 has slots at each end for the purpose of engaging the above-mentioned tungsten rods and to prevent rotation thereof. Such rods, at least in the lamp shown in U.S. Pat. No. 3,543,962, may also serve as the lead-in members for the lamp. Of course, these rods must have sufficient rigidity to permit takeup of filament slack without deflection and to adequately support the filament mounted bridge. Preferably, also, electrical connection is established between the rod and the filament by a compressive connector coil of the type shown in U.S. Pat. No. 3,497,752. Such a coil constrictively encircles the lead-in rod and an abutting portion of the filament leg. Protruding arms of these coils can provide some degree of mount stabilization, but for larger, high power lamps, the coil arms alone are not sufficient for this purpose and have occasionally broken off.

Although the lamp described in U.S. Pat. No. 3,543,962 represented a significant improvement in the art, such a filament mount structure, when employed in large, high-power studio lamps, can exhibit fracture and breakage problems under shock and vibration. Previous approaches for countering this problem included projection of one of the supporting lead-in wires or rods (or a bridge-connected wire) into the exhaust tip to provide rigidity at the free end of the mount. This design was tried without success in large high power lamps, as, during shock and vibration testing, breakage occurred on the bridge member used to anchor the projecting wire. Other prior designs dealt with the mount wobble problem by embedding the support rods at each end of the bulb in a press seal. Such a tungsten-to-quartz seal, however, can lead to cracks at the seal area due to thermal expansion differences, and the approach is somewhat unfeasible for large high-power lamps. Yet another prior method that has been employed to rigidize the mount of smaller, low power lamps involved the use of a wall bumper tungsten wire loop at the free ends of the tungsten support rod, which loop engaged the dome-side area of the lamp envelope. One such example of this engagement is depicted in U.S. Pat. No. 3,898,505 (Danko). This circular loop-support rod construction is deemed not only relatively expensive but, in the case of high power lamps, relatively brittle and thus subject to breakage.

Still a further approach is shown in U.S. Pat. No. 3,626,236 (Robinson et al), wherein internally projecting quartz tubes are sealed to the interior of the envelope, and coils on the upper ends of the support rods fit into these tubes to secure the top of the mount. Although perhaps satisfactory in smaller, lower power lamps with a press seal base, such an upper support means is unsatisfactory for large high power lamp structures. The lever action of the rods or coils on the depending tubes can cause the tubes to break off, especially for the cup seal-supported rod structures typical for high power lamps. Further, the construction appears difficult and expensive to fabricate in production.

In yet another example, as depicted in U.S. Pat. No. 3,909,653 (Bottone et al), the lamp's support rods include V-shaped intermediate sections designed to slidably contact the inner side walls of the envelope. This engagement, also requiring a "spud wire" for being sealed within the envelope's tipped-off section, requires a specifically shaped (oval) envelope to assure centralized filament location. Additionally, such an arrangement is deemed relatively expensive to manufacture.

In U.S. Pat. No. 4,023,060 (Pike et al), also assigned to the same assignee as the present invention, there is described a high power tungsten-halogen lamp wherein the filament, a folded structure, is suspended between bridge members comprised of alumina tubing and supported by a pair of vertically disposed tungsten support rods which in turn are retained in respective cavities provided in the envelope's dome. Such an arrangement, requiring a specially designed envelope and aligned positioning of the parallel rods therein, is also deemed relatively expensive from a manufacturing standpoint.

It is believe, therefore, that an electric lamp, and particularly a tungsten-halogen lamp of the high power variety, posessing an improved means of supporting the filament structure therein which overcomes the several disadvantages associated with the aforementioned lamps would constitute a significant advancement in the art.

DISCLOSURE OF THE INVENTION

It is therefore, a primary object of this invention to enhance the electric incandescent lamp art by providing improved means for supporting the filament structure within the envelope of such a lamp.

It is a particular object of the invention to provide such a means which is of rugged, relatively simple construction and thus relatively inexpensive to produce and utilize in the finished product.

It is an even more particular object of this invention to provide such a means which can be utilized in a high power (e.g., 5,000 watts or greater), tungsten-halogen lamp such as used in television and theater lighting applications.

In accordance with one aspect of the invention, there is provided an improved electric lamp having a hermetically-sealed, light-transmitting envelope having an internal curvilinear wall, a gas mixture within the envelope, at least two support rods extending within the interior of the envelope in a spaced-apart manner, at least one bridge member within the envelope and supported substantially between the support rods, and a filament structure located within the envelope and suspended from the bridge member. The improvement comprises the providing of at least one support member secured to the bridge member and projecting therefrom and including a U-shaped end portion engaging the internal curvilinear wall of the envelope. The support member is thus able to provide both compressive and axial support for the bridge member and filament structure suspended therefrom in a ruggedized, facile and relatively inexpensive manner.

According to another aspect of the invention, the lamp includes a gas mixture of an inert gas and a halogen, and the filament structure is a folded, coiled tungsten filament. The bridge members, two in number, are each of alumina material and the support members, also two in number and located within the upper of the two bridge members, are each a wireform of molybdenum material.

BRIEF DESCRIPTION OF THE DRAWINGS

FIG. 4 being taken along the line 4—4 in FIG. 3.

BEST MODE FOR CARRYING OUT THE INVENTION

Figure 1:
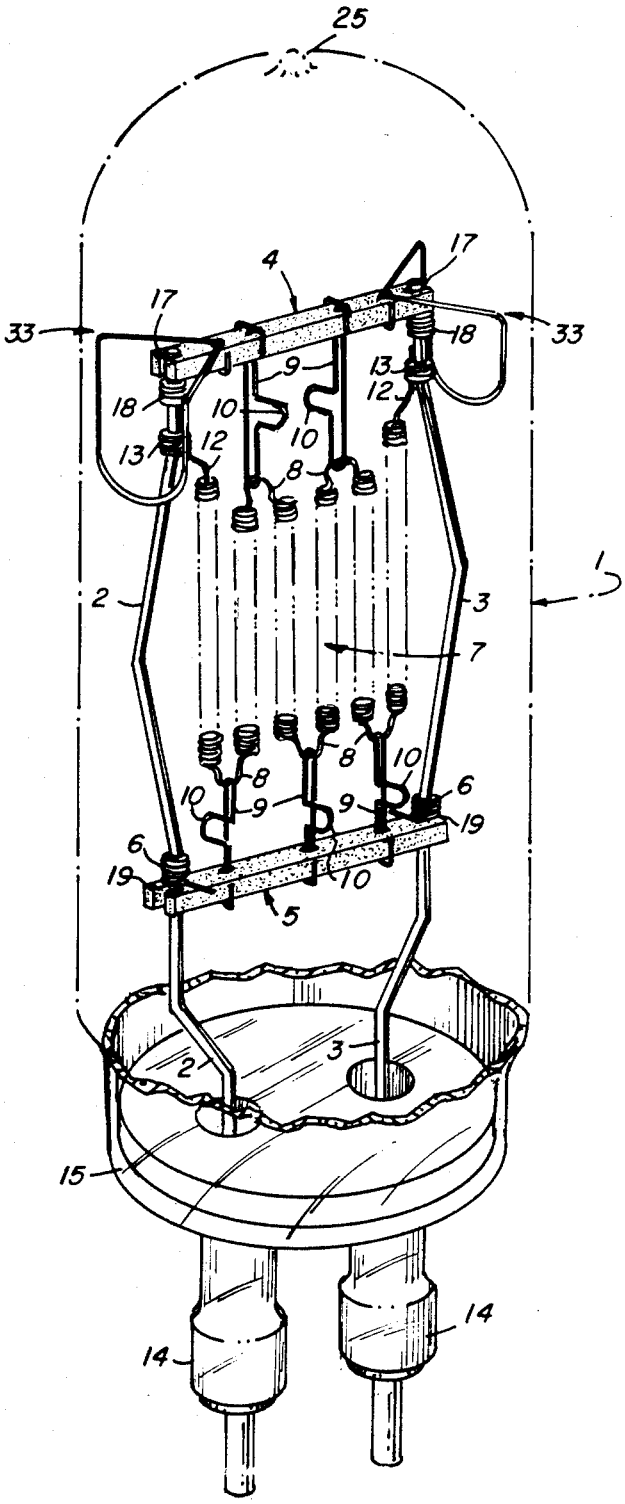
FIG. 1 is a perspective view of an electric incandescent lamp in accordance with a preferred embodiment of this invention.
Figure 2:
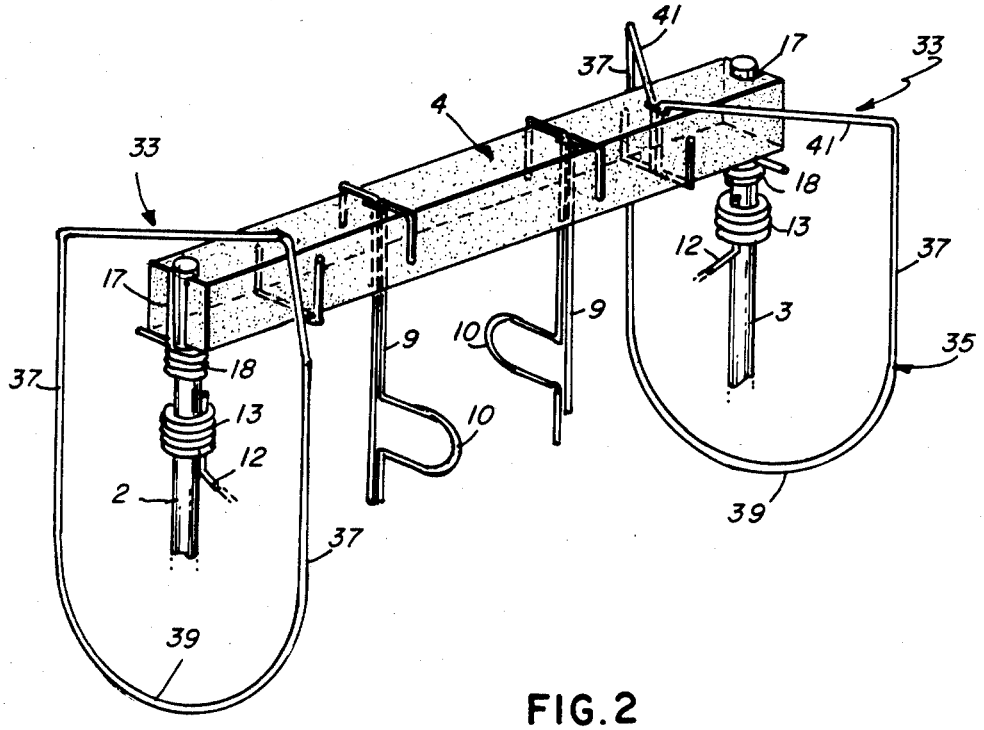
FIG. 2 is an enlarged perspective view of one of the bridge members of the lamp of FIG. 1 containing therein two of the support members of the invention, the envelope and various parts of the lamp not being shown for clarification purposes.

FIG. 1 of the drawing illustrates a high power (5,000 watt) studio lamp made in accordance with the present invention. Tubular envelope 1 is formed of quartz and is about 2.00 inches in diameter by about 4.50 inches long, excluding the base end thereof. Wall thickness for envelope 1 is about 2 millimeters (mm). The envelope is light-transmitting and hermetically sealed. Support rods 2 and 3 (which also function as lead-in conductors) are tungsten rods, 0.125 inch in diameter, and are supported in cylindrical quartz-to-molybdenum cup seals 14 at the base 15 of the lamp and extend into the interior of the envelope, generally in parallel. Rods 2 and 3 are about 0.88 inch apart at the base end of the lamp and about 1.50 inch apart at the filament mount portion thereof. Disposed between and supported at the upper portions of rods 2 and 3 is a section of alumina which functions as the upper bridge member 4 of the invention. Bridge member 4 is 1.63 inches long and has a rectangular cross-sectional configuration having a width of about 0.25 inch and a height of about 0.19 inch. This bridge member, as is the other bridge in the invention (described below), is preferably of solid construction, and not hollow or possessing cavities or the like internally thereof. Each end of alumina bridge member 4, however, has a vertical slot 17 therein, 0.16 inch wide by 0.19 inch long. Rods 2 and 3 pass vertically through slots 17 and terminate approximately flush with the upper surface thereof. Bridge member 4 (see especially FIG. 2) is prevented from downward movement on rods 2 and 3 by compressive coils 18 which encircle the rods and abut the lower side of each end of the bridge.

As also shown in FIG. 1, a second, lower alumina bridge member 5 is used. Preferably, this lower bridge is substantially similar to bridge 4 and is supported between rods 2 and 3 at a point about 3.50 inches below the upper bridge. Bridge 5 is parallel to bridge 4 and also has vertical slots 19 at the ends thereof, the slots being the same size as those (17) of the upper bridge. Vertical portions of rods 2 and 3 fit into slots 19, with lower bridge 5 being prevented from movement upward on rods 2 and 3 by compressive coils 6 encircling rods 2 and 3, and abutting the upper surface of each end of bridge 5.

Planar filament 7, shown partly in phantom in FIG. 1, is centrally disposed between opposed bridges 4 and 5. Filament 7 is made of a single length of 0.045 inch diameter tungsten wire and comprises six coiled sections (as shown), each section being about 1.25 inches long by 0.175 inch diameter. The six coiled sections are substantially parallel to each other and define a rectangular area of about 1.50 inches by 1.25 inches. Connecting adjacent coiled sections to each other are single wire loops 8, extending about 0.13 inch beyond the ends of the coiled sections. As illustrated in FIG. 1, there are two such loops at the upper part of filament 7 and three at the lower part.

Each loop 8 is supported and maintained in tension by a support wire 9, extending from the respective, adjacent alumina bridge to the loop. Each support wire 9 is made of a single length of 0.030 inch diameter molybdenum wire and extends through a substantially rectangular hole in the respective, solid alumina bridge substantially in alignment with its respective loop 8. Each support wire is also preferably folded around the respective loop, doubled back through the hole, and bent securely around the bridge in the manner shown. One side of each support wire 9 has a U-shaped loop 10, about 0.25 inch long by 0.19 inch wide. At the time of mounting filament 7, each loop 10 can be squeezed to draw up any slack on filament 7 between bridges 4 and 5.

The use of solid alumina for bridge members 4 and 5, in accordance with one aspect of the invention, contributes significantly to the strength of the mount structure. Alumina is hard and durable, and less expensive than quartz. It is relatively easy to fabricate into the desired rectangular shape and withstands shock and vibration testing of the lamp assembly. Of further significance, the alumina material does not interfere with the halogen cycle in the lamp.

Legs 12 of filament 7 extend from the upper ends of the outermost coiled sections thereof, and are bent so that portions thereof abut and are substantially parallel to rods 2 and 3, respectively, at a point about 0.19 inch below bridge 4. Compressive coils 13, encircling legs 12 and the respective rods, provide a secure electrical connection therebetween (see especially FIG. 4).

The sections of rods 2 and 3 in closest proximity to the outermost coiled sections of filament 7 are bent at the center thereof, preferably at an angle of about 135 degrees, the purpose being to increase the spacing therebetween and thus to reduce the cooling effect of the rods on the filament.

During assembly of the filament mount, coils 6 are first inserted on preshaped rods 2 and 3. The external ends of rods 2 and 3 are then clamped in a suitable holding device and coils 13 and 18 are inserted on the rods. Filament 7 is then assembled on bridges 4 and 5 by means of support wires 9, with the bridges then mounted on rods 2 and 3. Rods 2 and 3 have sufficient flexibility to be spread apart enough for the mounting of the bridges. Legs 12 of filament 7 are then connected to their respective rods by means of coils 13. Filament 7 is then centrally positioned in the bridge and loops 10 of support wires 9 are squeezed, where necessary, to take up any slack in filament 7. Tungsten rods 2 and 3 are then braced to the molybdenum cups which had previously been sealed at 14 to the quartz base 15.

In accordance with the teachings of the instant invention, there is provided an improved means for providing support of the filament structure within envelope 1 which is of rugged, relatively simple construction, is relatively inexpensive to produce, and which enables facile assembly of lamp 1. Specifically, the improvement to the lamp as defined herein comprises the provision of at least one support member 33 which, as illustrated in the drawings, is secured to bridge member 4 and projects therefrom. In accordance with a preferred embodiment of the invention, the lamp includes two support members 33, each located within an opposing end of the upper bride member 4. See especially FIG. 2. Because both support members 33 are similar, like numerals will be utilized to define the corresponding elements thereof. Although two members 33 are shown in the drawings, it is within the broadest aspects of this invention to utilize but a singular such support member to accomplish the results desired. However, two support members 33 are utilized in the preferred embodiment.

Figure 3:
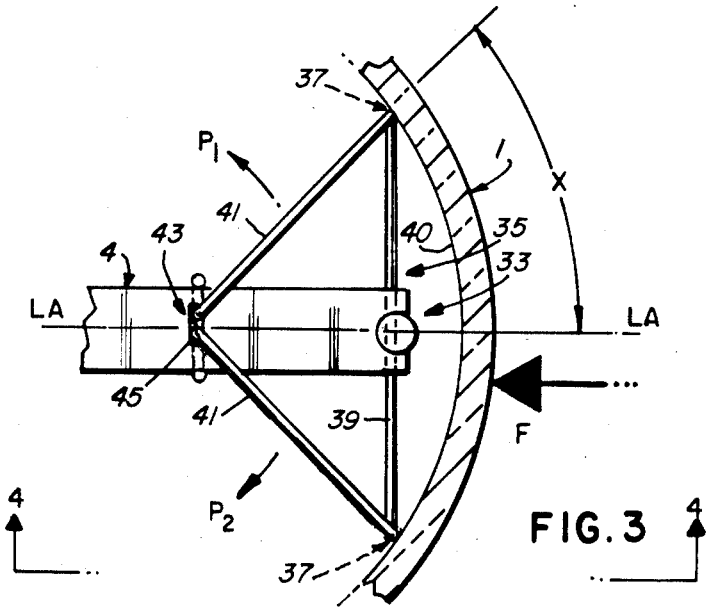
FIG. 3 is an enlarged, partial plan view, in section, illustrating how the support member of the invention is positioned within the respective bridge member and further how this member engages the curvilinear internal wall of the lamp's envelope.

Each support member 33 includes a U-shaped end portion 35 having a pair of spaced side segments 37, each of equal length, joined together by a lower curvilinear section 39. As will be defined herein, utilization of support member 33 in the manner defined provides both compressive and axial support for bridge member 4 and thus the filament structure suspended therefrom. This dual function is attained by engaging the curvilinear, internal wall 40 of envelope 1 with the U-shaped end portion 33 such that the equal length side segments 37 are positioned substantially flush thereagainst. This is better illustrated in FIG. 4. Joining each side segment to bridge member 4 is a leg portion 41 of substantially straight configuration. As best illustrated in FIG. 3. leg portions 41 are of substantially equal length and secured to bridge 4 at a common location 43. Specifically, each leg portion 41 passes through a substantially rectangular aperture 45 provided through bridge member 4 and is substantially wrapped thereabout. Most significantly, each leg portion is capable of pivoting about location 43 such that the entire support member 33 may also pivot (i.e., should an external force F of sufficient magnitude be applied against the envelope's outer surface relative to the curvilinear, internal wall 40).

Each leg portion 41 forms an angle (X) relative to the longitudinal axis (LA-LA) of bridge member 4. Preferably, this angle is about 45 degrees such that the total angle between leg portions 41 is approximately 90 degrees. The aforementioned unique pivotal arrangement is such that, as described, both leg portions 41 may pivot simultaneously in one direction (i.e., P1) or in a substantially opposing second direction (i.e., P2) upon application, should excessive force be applied (i.e., substantially along the longitudinal axis LA-LA), both leg portions 41 are designed for pivoting outwardly, away from each other, to thereby enable the support member 33 to compensate for this excessive force and prevent corresponding damage to bridge member 4 (and the suspended filament structure).

Figure 4:
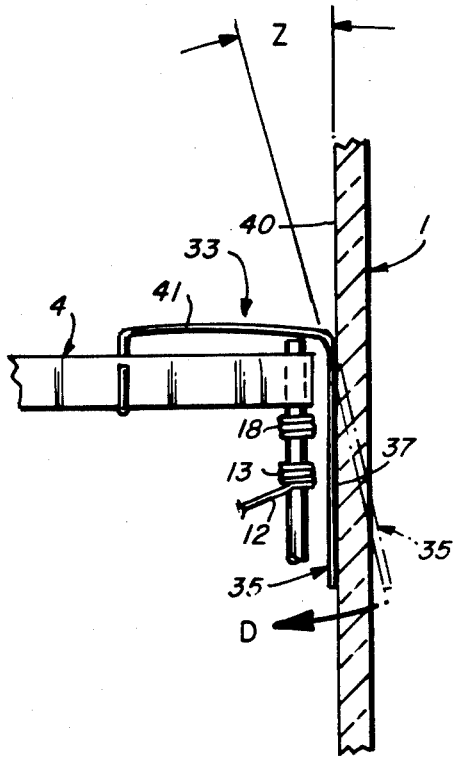
FIG. 4 is an enlarged, partial side view, in elevation, further illustrating how the support member of the invention engages the aforementioned, internal curvilinear wall.

With particular attention to FIG. 4, the substantially flush engagement by the straight side sections 37 of support member 33 is shown. Also shown in FIG. 4 (in phantom) is the original shape of U-shaped end portion 35 prior to this engagement. Specifically, the U-shaped end portion of support member 33 is bent angularly (angle Z) relative to the internal wall 40 of envelope 1 such that it must deflect inwardly (deflection D) during positioning within envelope 1. Such inward deflection provides the aforementioned compressive support for bridge member 4 to force it in a direction substantially away (and vertical to) to envelope's inner wall. The aforementioned pivotal orientation of support member 33 thus provides the aforementioned axial support for bridge member 4 to thus facilitate centralizing thereof within envelope 1. In a preferred embodiment, angle Z is within the range of from about 5 to about 25 degrees and in a particular embodiment was 15 degrees. The aforementioned angle between leg portions 41, as defined, is preferably about 90 degrees although angles within the range of from about 80 degrees to about 100 degrees are deemed acceptable.

Of particular significance, each of the support members 33 of the invention is not directly connected to the electrically conductive filament structure within envelope 1. As shown, each support member 33 is instead positioned within the electrically insulative bridge member (4) at an isolated location from the nearest conductive part (i.e., compressive coil 18) of the structure. Significantly, each support member will thus not provide a direct thermal path to the wall of envelope 1. Such transference of heat, if direct contact with the envelope's quartz material were provided, has been proven to adversely affect the wall of the envelope (e.g., cause "blistering" thereof). This is prevented by the support member-alumina bridge arrangement defined herein and represents an important feature of the instant invention.

After positioning of the defined bridge member-filament structure-support member assembly within the tubular quartz envelope 1, envelope 1 is exhausted through an exhaust tube situated at the upper end thereof and filled with a gas mixture comprised of an inert gas and a halogen. Thereafter, the exhaust tube is sealed by constriction to form a tip 25. One example of a suitable gas mixture for use in the invention comprises bromine and nitrogen at a pressure of about 750 torr.

Preferably, each of the support members used herein is comprised of a wireform which in turn has been formed from a singular piece of molybdenum wire having an original length of about six inches and an outer diameter of about 0.040 inch. Use of molybdenum for these members is deemed particularly advantageous from a cost standpoint and is not harmful to the internal atmosphere essential for envelope 1. Such material in wireform configuration such as disclosed herein also assures the resilience necessary to accomplish the results describes herein while still assuring a ruggedized construction which is relatively inexpensive to provide.

Although the invention has been described with particular regard to a tungsten-halogen lamp of the high power (wattage) variety, it is understood that the teachings herein are also applicable to other types of lamps wherein a bridge member and suspended filament structure are utilized. For example, the teachings as provided herein are also adaptable to low power tungsten-halogen lamps and the like wherein a bridge member has often been found desirable.

While there have been shown and described what at present are considered the preferred embodiment of the invention, it will be obvious to those skilled in the art that various changes and modifications may be made therein without departing from the scope of the invention as defined by the appended claims.

What is claimed is:

1. In an electric lamp including an hermetically-sealed, light-transmitting envelope having an internal curvilinear wall, a gas mixture within said envelope, at least two support rods extending within the interior of said envelope in a spaced-apart manner, at least one bridge member within said envelope and supported substantially between said support rods, and an electrically conductive filament structure located within said envelope and suspended from said bridge member, the improvement comprising:

at least one support member secured to said bridge member and projecting therefrom and including a U-shaped end portion engaging said internal curvilinear wall of said envelope and a pair of leg portions, each of said leg portions secured to said bridge and projecting therefrom at an angle relative to the other, said support member providing both compressive and axial support for said bridge member and said filament structure suspended therefrom.

2. The improvement according to claim 1 wherein said filament structure comprises a plurality of coiled tungsten filaments and said gas mixture includes an inert gas and a halogen.

3. The improvement according to claim 1 wherein said light-transmitting envelope is comprised of quartz.

4. The improvement according to claim 1 wherein said bridge member is comprised of alumina and is of substantially solid construction.

5. The improvement according to claim 1 wherein said angle is within the range of from about 80 degrees to about 100 degrees.

6. The improvement according to claim 1 wherein said leg portions are each of substantially straight configuration and are substantially equal in length.

7. The improvement according to claim 6 wherein each of said leg portions of said support member are secured to said bridge member at a common location, said support member movable in a pivotal manner relative to said common location.

8. The improvement according to claim 7 wherein said leg portions are capable of deflecting outwardly relative to each other in response to application of an external force to said envelope relative to said curvilinear wall.

9. The improvement according to claim 1 wherein said support member is a wireform.

10. The improvement according to claim 9 wherein said wireform is comprised of molybdenum.

11. The improvement according to claim 1 wherein the number of said support members is two, each of said support members secured to said bridge member at opposing ends thereof.

12. The improvement according to claim 1 wherein said support member secured to said bridge member is not directly connected to said electrically conductive filament structure, said support member thus not providing a direct thermal path between said filament structure and said internal wall of said envelope.

* * * * *